US011986876B1

(12) United States Patent
Deng et al.

(10) Patent No.: US 11,986,876 B1
(45) Date of Patent: May 21, 2024

(54) PIPE EXPANDING HEAD, PIPE EXPANDING HEAD ASSEMBLY AND PIPE EXPANDING PLIER

(71) Applicant: Zhuji ITOP Hardware Tools Co., Ltd., Zhuji (CN)

(72) Inventors: Xiaoming Deng, Zhuji (CN); Jiulian Xu, Zhuji (CN)

(73) Assignee: Zhuji ITOP Hardware Tools Co., Ltd., Zhuji (CN)

( * ) Notice: Subject to any disclaimer, the term of this patent is extended or adjusted under 35 U.S.C. 154(b) by 0 days.

(21) Appl. No.: 18/478,859

(22) Filed: Sep. 29, 2023

(30) Foreign Application Priority Data

Mar. 14, 2023 (CN) ..... 202320476328.5

(51) Int. Cl.
*B21D 41/02* (2006.01)

(52) U.S. Cl.
CPC ..... *B21D 41/021* (2013.01)

(58) Field of Classification Search
CPC ..... B29C 57/04; B29C 57/02; B29C 57/045; B21D 41/021; B21D 41/02; B21D 41/00
See application file for complete search history.

(56) References Cited

U.S. PATENT DOCUMENTS

| | | | | |
|---|---|---|---|---|
| 5,090,230 | A * | 2/1992 | Koskinen | B21D 41/026 72/393 |
| 5,928,451 | A * | 7/1999 | Johansson | B29C 57/02 264/296 |
| 2020/0094465 | A1* | 3/2020 | Lindsey | B29C 57/04 |
| 2021/0023767 | A1* | 1/2021 | Brochman | B29C 57/04 |
| 2022/0324008 | A1* | 10/2022 | Davies | B21D 39/20 |

* cited by examiner

*Primary Examiner* — Bobby Yeonjin Kim
(74) *Attorney, Agent, or Firm* — Schwegman Lundberg & Woessner, P.A.

(57) ABSTRACT

A pipe expanding head, a pipe expanding head assembly, and a pipe expanding plier are provided. A distance from a point on an outer periphery of a largest radial cross section of the first joint arc part to the central axis is not less than a distance from a point on an outer periphery of the first radial cross section to the central axis, and the distance from the point on the outer periphery of the largest radial cross section of the first joint arc part to the central axis is larger than a distance from a point on an outer periphery of the second radial cross section to the central axis; and a distance from a point on an outer periphery of a largest radial cross section of the second joint arc part to the central axis is also similar.

20 Claims, 6 Drawing Sheets

PIPE EXPANDING HEAD, PIPE EXPANDING HEAD ASSEMBLY AND PIPE EXPANDING PLIER

CROSS-REFERENCE TO RELATED APPLICATION

This Non-provisional application claims priority under 35 U.S.C. § 119(a) to Chinese Patent Application No. 202320476328.5, filed on 14 Mar. 2023, the entire contents of which is hereby incorporated by reference in its entirety.

TECHNICAL FIELD

The disclosure relates to a pipe expanding tool, and specifically to a pipe expanding head, a pipe expanding head assembly, and a pipe expanding plier.

BACKGROUND ART

Pipeline expansion tools are widely used in a field of pipelines, such as in domestic hot and cold water pipelines and domestic heating pipings, in which it is necessary to expand a flexible pipe with extensibility, so that the expanded flexible pipe can be sleeved on another joint to realize installation and connection of pipelines.

In an existing pipeline expansion process, a flexible pipe is expanded by using a pipe expanding plier, and an orifice at an end of the flexible pipe is expanded to a certain diameter through continuous expansion from a pipe expanding head on the pipe expanding plier. A PEX expansion tool is disclosed in a U.S. patent publication No. US20200094465A1, in which each jaw 126 on the PEX expansion tool includes an outer side with a first tapered portion 140, a first sized portion 144 adjacent to the first tapered portion 142, a second tapered portion 148 and a second sized portion 152 adjacent to the second tapered portion 148. The first tapered portion 140 and the second tapered portion 148 extend obliquely with respect to a longitudinal axis 138, and the first sized portion 144 and the second sized portion 152 extend substantially parallel to the longitudinal axis 138. Each jaw 126 includes a first shoulder 156 located between the first sized portion 144 and the second tapered portion 148.

If the PEX expansion tool is used in practical applications, there are following defects, as shown in FIG. 1. 1. The jaw 126 gradually penetrates into a flexible pipe 200 along an X direction to expand. When an orifice of the flexible pipe 200 is located at the first sized part 144 or the second sized part 152 of the jaw 126, the jaw 126 may generate a component force in the X direction to the flexible pipe 200 in one expanding action because surfaces of the first sized part 144 and the second sized part 152 are smooth and parallel to the is longitudinal axis 138, which results in slippage between the jaw 126 and the flexible pipe 200 and thus displacement of the flexible pipe 200 in the X direction relative to the jaw 126. Therefore, it is necessary to perform more expansion actions during operation, which reduces efficiency of pipe expanding operations. 2. The first shoulder 156 is arranged between the first sized part 144 and the second tapered part 148. Existence of the first shoulder 156 makes the flexible pipe 200 not smooth from an expanding action in the first sized part 144 to an expanding action in the second tapered part 148, which results in a situation that the flexible pipe 200 is prone to bursting during secondary expanding.

SUMMARY

To solve the above problems, the technical scheme provided in the disclosure is as follows:

A pipe expanding head is provided, which includes pipe expanding pieces which are circumferentially distributed along a direction of a central axis. The pipe expanding pieces each include a first external tooth arc part, a first joint arc part, a second external tooth arc part, a second joint arc part and a positioning part which are sequentially arranged along the direction of the central axis of the pipe expanding head. Outer surfaces of the first external tooth arc part and the first joint arc part are in a same arc surface, and outer surfaces of the second external tooth arc part and the second joint arc part are in a same arc surface. The pipe expanding piece moves between a closed position and an expanded position in a radial direction;

external teeth are provided on both the first external tooth arc part and the second external tooth arc part, and a distance from the external tooth on the first external tooth arc part to the central axis decreases is sequentially along the direction of the central axis, while a distance from the external tooth on the second external tooth arc part decreases sequentially along the direction of the central axis;

a first radial cross section is taken as an interface between the first external tooth arc part and the first joint arc part, and a second radial cross section is taken as an interface between the first joint arc part and the second external tooth arc part; and a distance from a point on an outer periphery of a largest radial cross section of the first joint arc part to the central axis is not less than a distance from a point on an outer periphery of the first radial cross section to the central axis, and the distance from the point on the outer periphery of the largest radial cross section of the first joint arc part to the central axis is larger than a distance from a point on an outer periphery of the second radial cross section to the central axis; and a third radial cross section is taken as an interface between the second external tooth arc part and the second joint arc part, and a forth radial cross section is taken as an interface between the second joint arc part and the positioning part; and a distance from a point on an outer periphery of a largest radial cross section of the second joint arc part to the central axis is not less than a distance from a point on an outer periphery of the third radial cross section to the central axis, and the distance from the point on the outer periphery of the largest radial cross section of the second joint arc part to the central axis is larger than a distance from a point on an outer periphery of the forth radial cross section to the central axis.

It is further provided in the disclosure that a distance from a point on an outer periphery of a radial section where an outer tooth on the second outer tooth arc part closest to the first joint arc part is located to the central axis is greater than the distance from the point on the is outer periphery of the largest radial section of the first joint arc part to the central axis.

It is further provided in the disclosure that a side of the positioning part close to the second joint arc part is provided with a stop boss, and a distance from a point on an outer periphery of a radial section of the stop boss to the central axis is greater than a distance from the point on the periphery of the largest radial section of the second joint arc part to the central axis.

It is further provided in the disclosure that radians of the outer surface of the first external tooth arc part and the outer surface of the first joint arc part along the direction of the central axis are smaller than those of the outer surface of the second external tooth arc part and the outer surface of the second joint arc part along the direction of the central axis respectively.

It is further provided in the disclosure that an outer surface of the positioning part is provided with an arc groove.

It is further provided in the disclosure that a side of the pipe expanding piece close to the central axis is provided with a stressed surface.

It is further provided in the disclosure that each pipe expanding piece is integrally formed.

It is further provided in the disclosure that the pipe expanding pieces are evenly distributed on an outer periphery of the central axis.

A pipe expanding head assembly is provided, which includes a connecting seat and the pipe expanding head described above. An opening is provided at both ends of the connecting seat. An annular positioning groove is provided in the connecting seat. The positioning part of the pipe expanding piece is connected in the annular positioning groove. An outer side of the positioning part is connected is with an elastic piece, and the elastic piece is configured to drive the pipe expanding piece to move from the expanded position to the closed position.

A pipe expanding plier is provided, which includes a body, a handle, a top cone and the pipe expanding head assembly described above. The pipe expanding head assembly is connected to the body, the handle is movably connected with the body, one end of the top cone is connected with the handle and the other end of the top cone is arranged between the pipe expanding pieces and located on the central axis.

Compared with related art, the technical schemes provided in the disclosure have the following beneficial effects.

According to the technical schemes, the outer surface of the pipe expanding piece is newly designed along the central axis, the first joint arc part is designed to be narrowed along a direction from the first external tooth arc part to the second external tooth arc part, and the second joint arc part is also designed to be narrowed along a direction from the second external tooth arc part to the positioning part. When the flexible pipe is expanded by using the first joint arc part or the second joint arc part, an inner wall of the expended flexible pipe has a structure of small outside-large middle-small inside along an expanding direction, so that the flexible pipe may not be displaced in an opposite direction to the expanding direction in an expanding process, and each action is effective in expanding the pipe and operation efficiency of expanding the pipe can be improved.

According to the technical schemes, abrupt shoulder design between the first joint arc part and the second external tooth arc part on the pipe expanding piece is canceled, the first joint arc part and the second external tooth arc part are bordered by the second radial section, and the distance from the external tooth on the second external tooth arc part to the central axis decreases sequentially to the second radial section along the direction of the central axis, so that when an actual pipe expanding action part of an pipe expanding action changes from the first joint arc part to the second external tooth arc part, deformation generated by the pipe expanding action on the orifice of the flexible pipe changes smoothly, which ensures that the pipe expanding action of the pipe expanding head is stable and reliable, without burst in expanding of the flexible pipe.

DETAILED DESCRIPTION

In order to further understand contents of the present disclosure, the present disclosure will be described in detail with reference to drawings and examples.

It should be noted that the embodiments in the present disclosure and the characteristics in the embodiments can be combined mutually in the case of no conflict.

In description of this disclosure, it should be noted that unless otherwise specified and limited, terms "installing", "coupling" and "connecting" should be understood broadly, for example, it can be "fixedly connecting", "integrally connecting", or "detachably connecting"; or it can be "mechanically connecting" or "electrically connecting", or it can be "communicating within two elements"; or it can be "directly connecting" or "indirectly connecting through an intermediate medium", and specific meanings of the above terms can be understood according to specific situations for ordinary shilled in the art.

Embodiment 1

Figure 3:
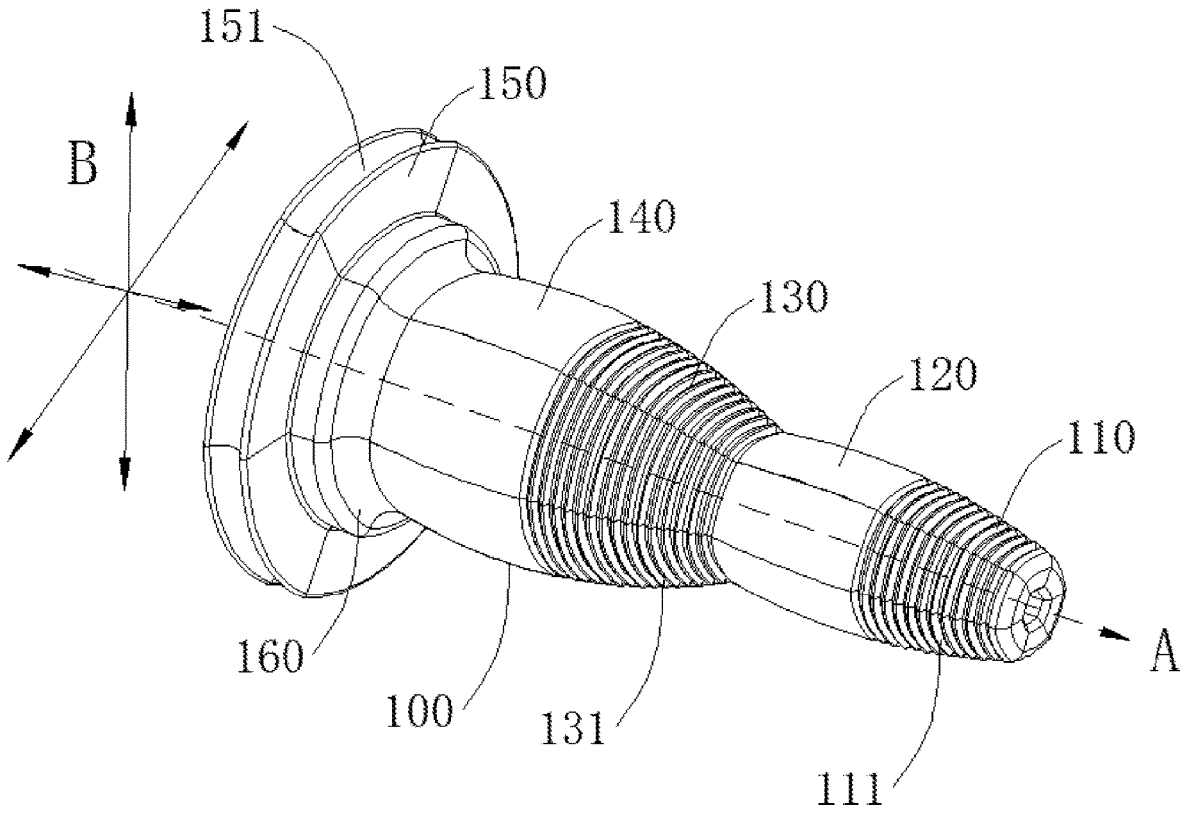
FIG. 3 is a perspective view of a pipe expanding head in a closed position according to Embodiment 1 of the disclosure.
Figure 4:
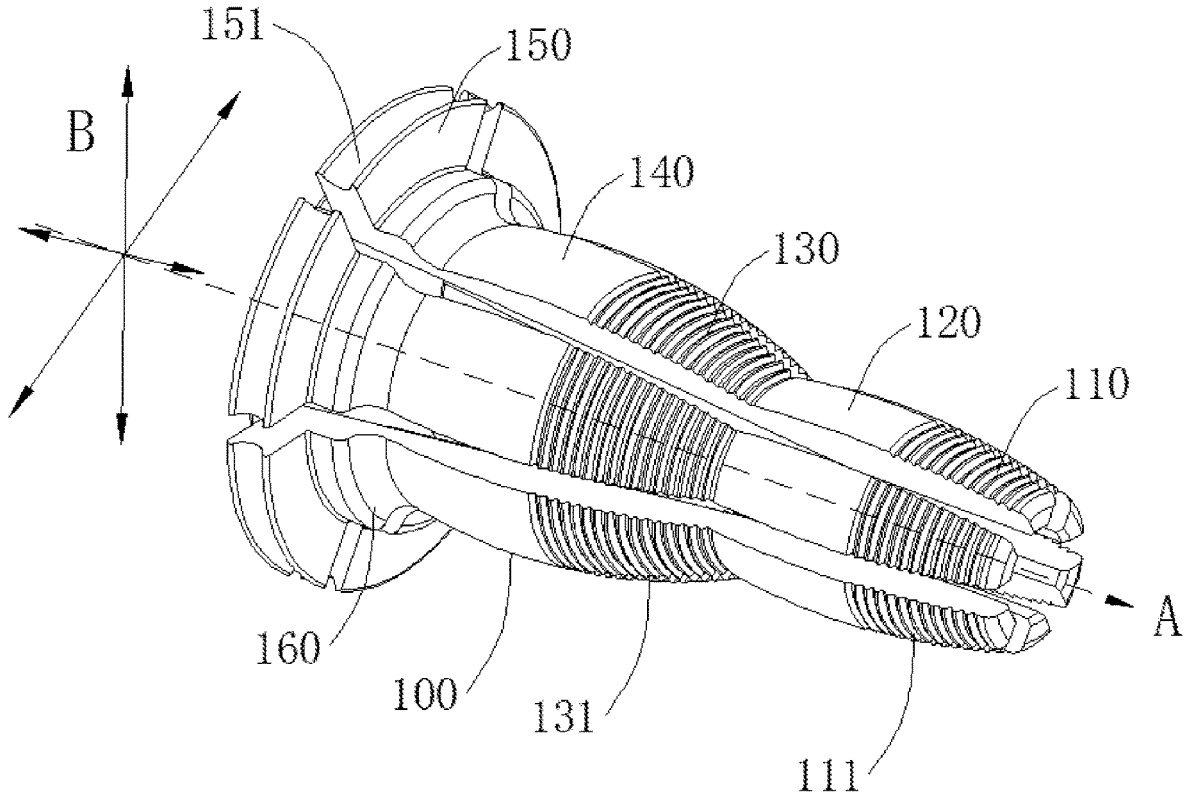
FIG. 4 is a perspective view of an expansion pipe head in an expanded position according to Embodiment 1 of the disclosure.
Figure 5:
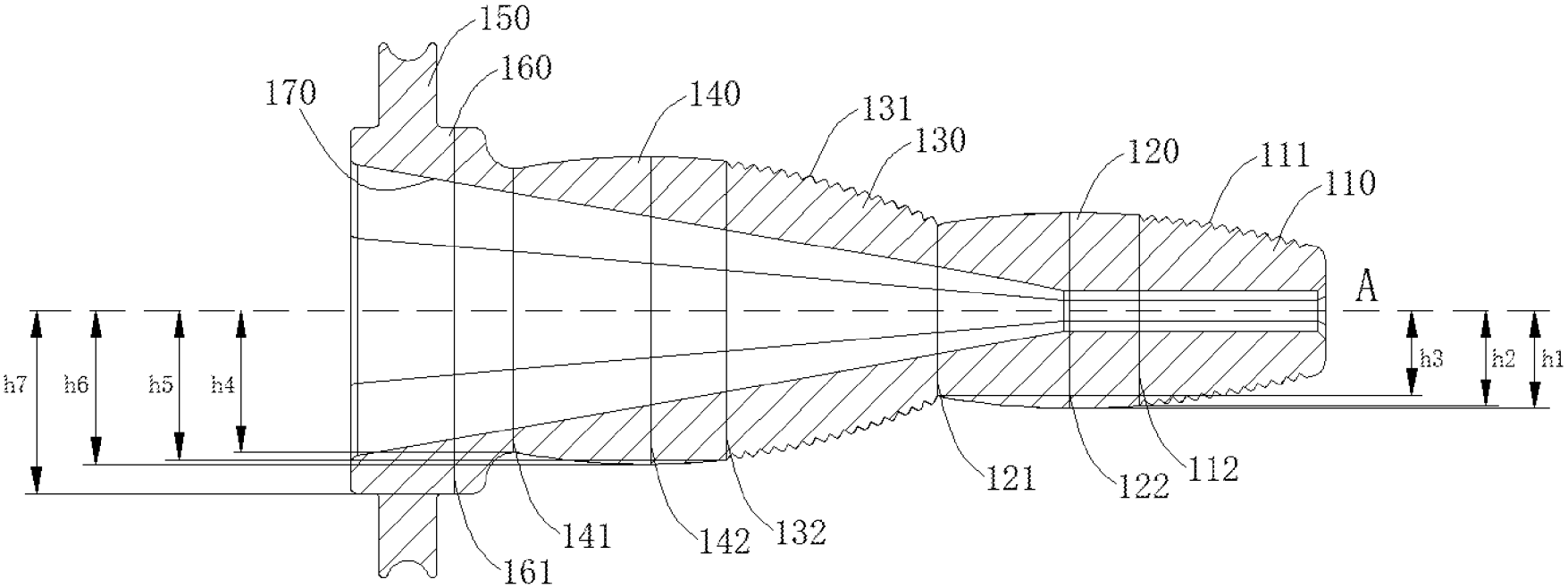
FIG. 5 is a cross-sectional view of an expansion pipe head according to Embodiment 1 of the disclosure.

With reference to FIG. 3 to FIG. 5, a technical scheme of this disclosure involves a pipe expanding head, which includes pipe expanding pieces 100 which are circumferentially distributed along a direction of a central axis A. The pipe expanding pieces 100 each include a first external tooth arc part 110, a first joint arc part 120, a second external tooth arc part 130, a second joint arc part 140 and a positioning part 150 which are sequentially arranged along the direction of the central axis A of the pipe expanding head 100. Outer surfaces of the first external tooth arc part 110 and the first joint arc part 120 are in a same arc surface, and outer surfaces of the second external tooth arc part 130 and the second joint arc part 140 are in a same arc surface. The pipe expanding piece 100 moves between a closed position and an expanded position in a radial direction B. As shown in FIG. 3, it is in the closed position, and as shown in FIG. 4, the pipe expanding head is in the expanded position.

An external tooth 111 is provided on the first external tooth arc part 110 and an external tooth 131 is provided on the second external tooth arc part 130, and a distance from the external tooth 111 on the first external tooth arc part 110 to the central axis A decreases sequentially along the direction of the central axis A, while a distance from the external tooth 131 on the second external tooth arc part 130 decreases sequentially along the direction of the central axis A.

As shown in FIG. 5, a first radial cross section 112 is taken as an interface between the first external tooth arc part 110 and the first joint arc part 120, and a second radial cross section 121 is taken as an interface between the first joint arc part 120 and the second external tooth arc part 130. A distance h1 from a point on an outer periphery of a largest radial cross section 122 of the first joint arc part 120 to the central axis A is not less than a distance h2 from a point on an outer periphery of the first radial cross section 112 to the central axis A, and the distance h1 from the point on the outer periphery of the largest radial cross section 122 of the first joint arc part 120 to the central axis A is larger than a distance h3 from a point on an outer periphery of the second radial cross section 121 to the central axis A.

As shown in FIG. 5 again, a third radial cross section 132 is taken as an interface between the second external tooth arc part 130 and the second joint arc part 140, and a fourth radial cross section 141 is taken as an interface between the second joint arc part 140 and the positioning part 150. A distance h6 from a point on an outer periphery of a largest radial cross section 142 of the second joint arc part 140 to the central axis A is not less than a distance h5 from a point on an outer is periphery of the third radial cross section 132 to the central axis A, and the distance h6 from the point on the outer periphery of the largest radial cross section 142 of the second joint arc part 140 to the central axis A is larger than a distance h4 from a point on an outer periphery of the forth radial cross section 141 to the central axis A.

In the embodiment described above, the external tooth 111 on the first external tooth arc portion 110 is arranged layer by layer along the direction of the central axis A. The external tooth 131 on the second external tooth arc portion 130 is also arranged by layer along the direction of the central axis A.

In the embodiment described above, a structure of the first external tooth arc part 110 is obtained by external tooth cutting similar to the first joint arc part 120, and a structure of the second external tooth arc part 130 is obtained by external tooth cutting similar to the second joint arc part 140.

In the embodiment described above, there is a case where the first radial cross section 112 is the largest radial cross section 122 of the first joint arc portion 120, that is, there may be a case where h1=h3. However, there must be no situation that the second radial cross section 121 is the largest radial cross section 122 of the first joint arc part 120. It is ensured that the first joint arc part 120 has a narrowed structure along a direction from the largest radial cross section 122 of the first joint arc part 120 to the second radial cross section 121, guaranteeing that the orifice of the flexible pipe 200 may not slip and displace when it is sleeved on the first joint arc part 120 for expanding of the pipe.

In the embodiment described above, there is a case that the third radial cross section 132 is the largest radial cross section 142 of the second joint arc part 140, that is, there may be a case that h6=h5; However, there must be no situation that the fourth radial cross section 141 is the largest radial cross section 142 of the second joint arc part 140. It is ensured that the second joint arc part 140 has a narrowed structure along the direction from the largest radial cross section 142 of the second joint arc part 140 to the fourth radial cross section 141, and it is ensured that the orifice of the flexible pipe 200 will not slip and displace when it is sleeved on the second joint arc part 140 to expand the pipe, thus significantly reducing a number of expanding.

In this embodiment, a distance from a point on an outer periphery of a radial section where an outer tooth 131 on the second outer tooth arc part 130 closest to the first joint arc part 120 is located to the central axis A is greater than the distance from the point on the outer periphery of the largest radial section 122 of the first joint arc part 120 to the central axis A. In this way, an outer tooth 131 on the second outer tooth arc part 130 closest to the first joint arc part 120 can serve as a cut-off surface in a first expanding stage; and when it is changed from the first expanding stage to a second expanding stage, with abrupt shoulder design between the first joint arc part and the second external tooth arc part on the expanded pipe being canceled in the pipe expanding head of the disclosure, the first joint arc part 120 and the second external tooth arc part 130 are bordered by the second radial section 121, and the distance from the external tooth 131 on the second external tooth arc part 130 to the central axis A decreases sequentially to the second radial section 121 along the direction of the central axis A, so that when an actual pipe expanding action part of an pipe expanding action changes from the first joint arc part 120 to the second external tooth arc part 130, deformation generated by the pipe expanding action on the orifice 210 of the flexible pipe 200 changes smoothly, which ensures that the pipe expanding action of the pipe expanding head is stable and reliable, without burst in expanding of the flexible pipe.

In this embodiment, a side of the positioning part 150 close to the second joint arc part 140 is provided with a stop boss 160, and a distance h7 from a point on an outer periphery of a radial section 161 of the stop boss 160 to the central axis A is greater than a distance from the point on the periphery of the largest radial section 142 of the second joint arc part 140 to the central axis A.

In this embodiment, radians of the outer surface of the first external tooth arc part 110 and the outer surface of the first joint arc part 120 along the direction of the central axis A are smaller than those of the outer surface of the second external tooth arc part 130 and the outer surface of the second joint arc part 140 along the direction of the central axis A respectively.

In this embodiment, an outer surface of the positioning part 150 is provided with an arc groove 151.

In this embodiment, a side of the pipe expanding piece 100 close to the central axis A is provided with a stressed surface 170.

In this embodiment, each pipe expanding piece 100 is integrally formed. All radial sections mentioned above are for better explaining a structure of the pipe expanding piece.

In this embodiment, the outer surface of the first joint arc part 120 and the outer surface of the second joint arc part 140 are both curved surfaces; A structure with the curved surfaces makes two joints smooth. As shown in FIG. 5, it is preferable that radian of the outer surface of the first joint arc part 120 is 0.20 to 0.25 rad in cross section, and radian of the outer surface of the second joint arc part 140 is 0.25 to 0.30 rad in cross section.

In this embodiment, the pipe expanding pieces 100 are evenly distributed on an outer periphery of the central axis A. Preferably, there is are six pipe expanding pieces 100.

Figure 1:
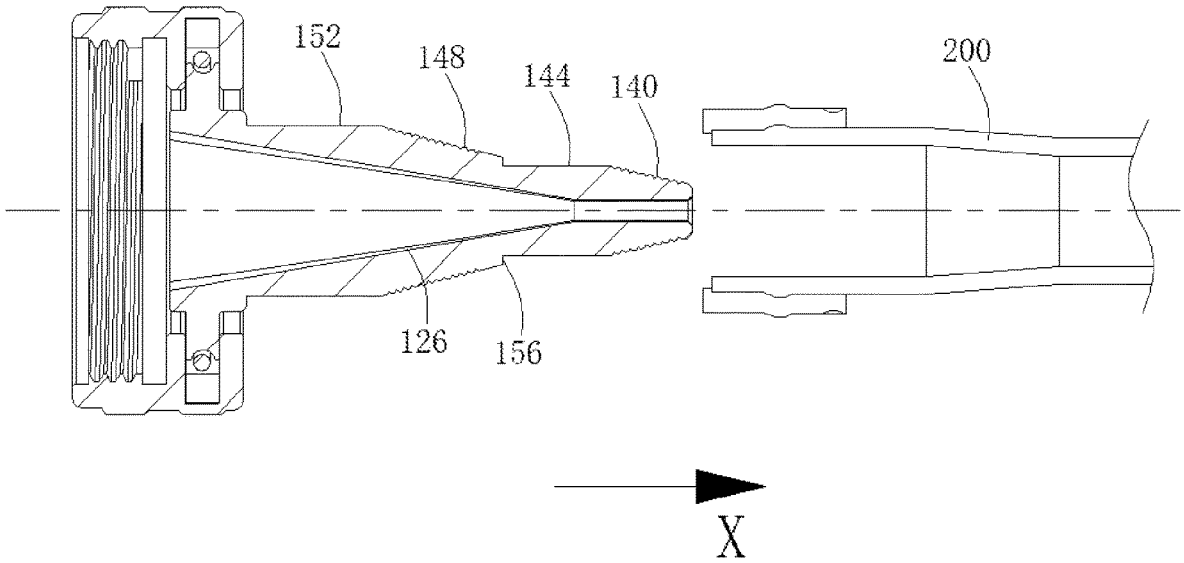
FIG. 1 (prior art)
FIG. 1 is a schematic diagram of expanding of a flexible pipe by a PEX expansion tool in related art.
Figure 2:
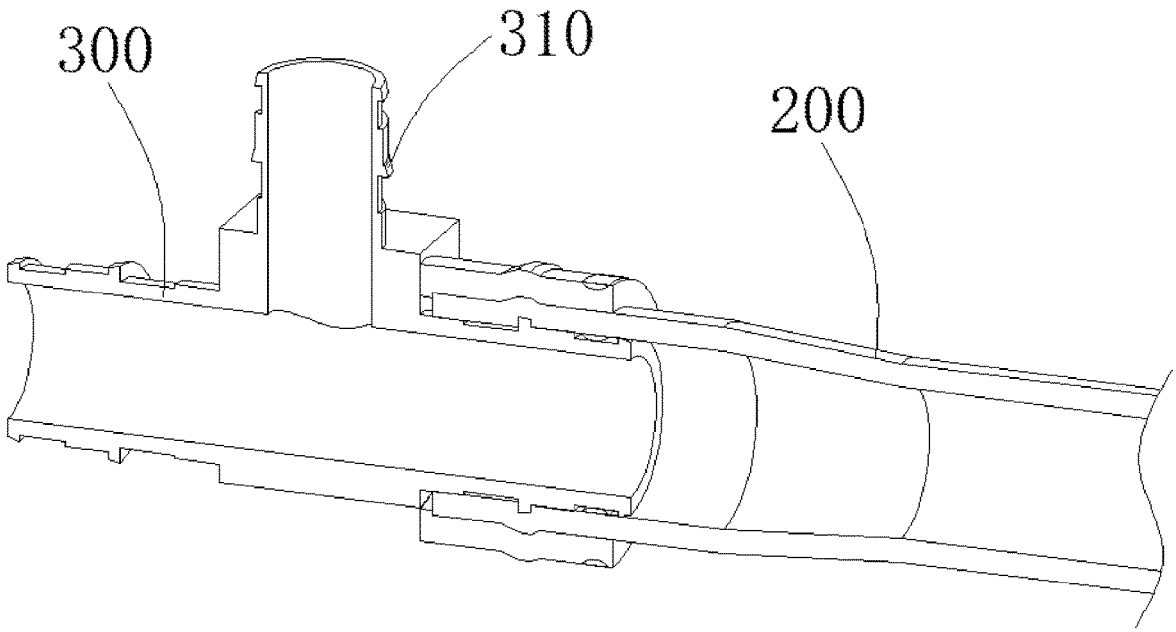
FIG. 2(prior art)
FIG. 2 is a schematic diagram of connection of the flexible pipe on a joint in the related art.
Figure 6:
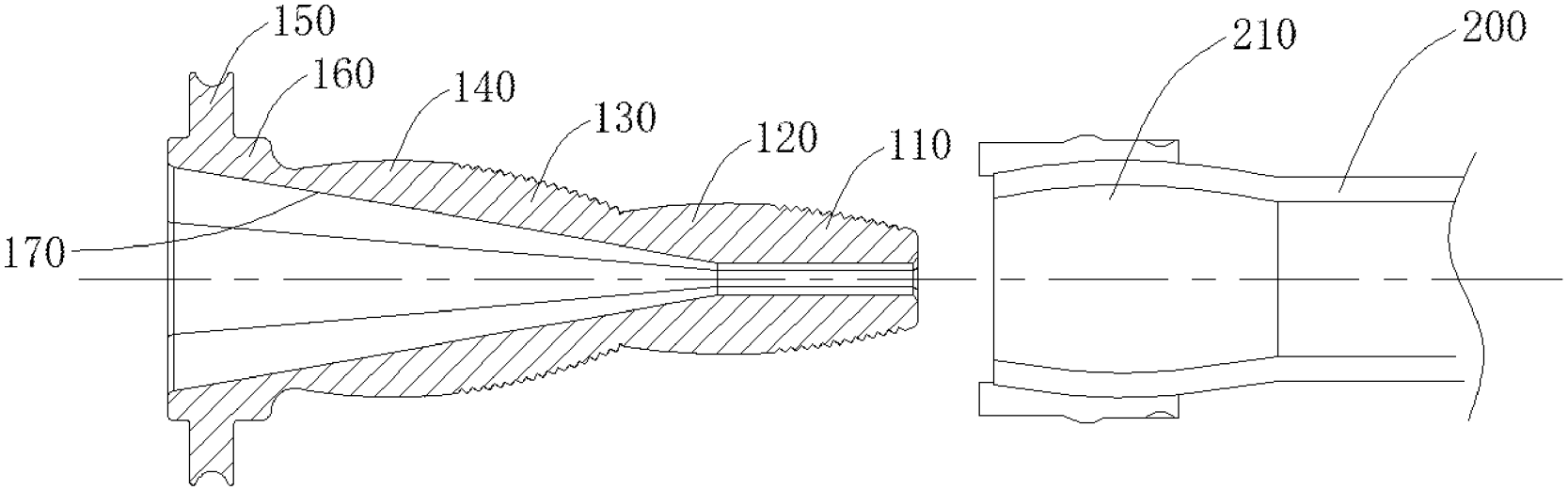
FIG. 6 is a schematic diagram of expanding of a flexible pipe by the pipe expanding head according to Embodiment 1 of the disclosure.
Figure 7:
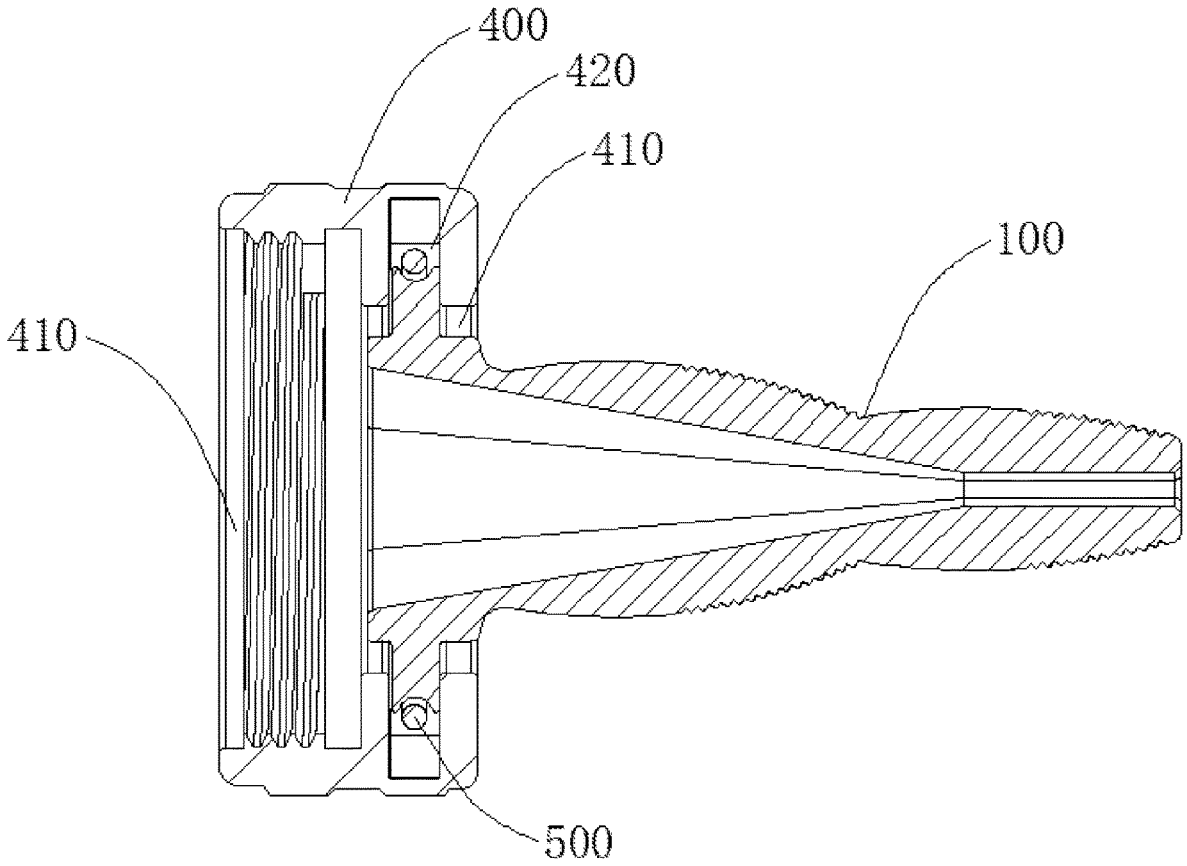
FIG. 7 is a cross-sectional view of an expansion pipe head according to Embodiment 2 of the disclosure.
Figure 8:
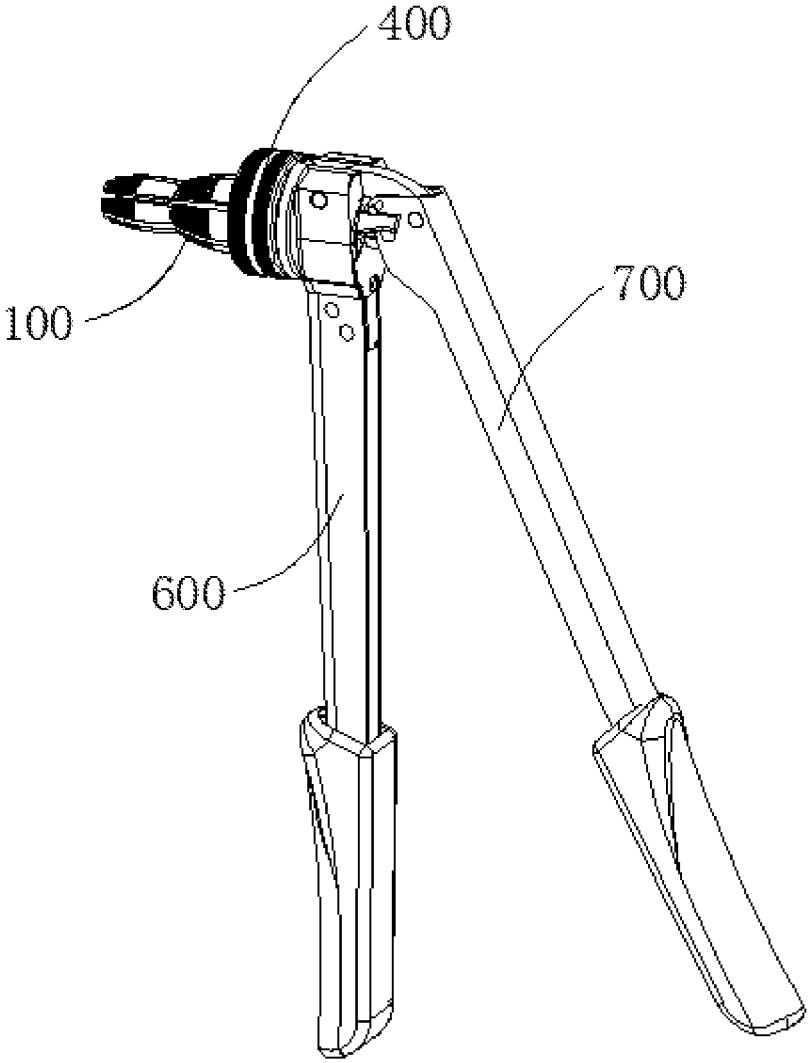
FIG. 8 is a perspective view of a pipe expanding plier of Embodiment 3 of the disclosure.

As shown in FIG. 2, which is a schematic diagram of a segment of flexible pipe 200 being connected to a three-way joint 300, there is a segment of annular protrusion 310 at orifices of most existing joints, that is, the orifice of the joint 300 has a structure of small outside-large middle-small inside. As shown in FIG. 6, an inner wall of the expended flexible pipe 200 expanded by adopting the pipe expanding head of this embodiment has a structure of small outside-large middle-small inside along an expanding direction. After the flexible pipe 200 is sleeved on the joint 300, both of them are highly compatible in structure, and the flexible pipe 200 and the joint 300 can be stably connected with better sealing performance under tightening of external contraction pieces.

According to the disclosure, the outer surface of the pipe expanding piece is newly designed along the central axis, the first joint arc part is designed to be narrowed along a direction from the first external tooth arc part to the second external tooth arc part, and the second joint arc part is also designed to be narrowed along a direction from the second external tooth arc part to the positioning part. When the flexible pipe is expanded by using the first joint arc part or the second joint arc part, an inner wall of the expended flexible pipe has a structure of small outside-large middle-small inside along an expanding direction, so that the flexible pipe may not be displaced in an opposite direction to the expanding direction in an expanding process, and each action is effective in expanding the pipe and operation efficiency of expanding the pipe can be improved.

Embodiment 2

With reference to FIG. 3 to FIG. 7, a technical scheme of the disclosure involves a pipe expanding head assembly, which includes a is connecting seat 400 and the pipe expanding head described in Embodiment 1. An opening 410 is provided at both ends of the connecting seat 400. An annular positioning groove 420 is provided in the connecting seat 400. The positioning part 150 of the pipe expanding piece 100 is connected in the annular positioning groove 420. An outer side of the positioning part 150 is connected with an elastic piece 500, and the elastic piece 500 is configured to drive the pipe expanding piece 100 to move from the expanded position to the closed position.

In this embodiment, the elastic member 500 is connected to arc grooves 151 of respective pipe expanding pieces 100.

Embodiment 3

With reference to FIG. 3 to FIG. 8, a technical scheme of the disclosure involves a pipe expanding plier, which includes a body 600, a handle 700, a top cone and the pipe expanding head assembly described in Embodiment 2. The pipe expanding head assembly is connected to the body 600, the handle 700 is movably connected with the body 600 via a pin shaft, one end of the top cone is connected with the handle 700 and the other end of the top cone is arranged between the pipe expanding pieces 100 and located on the central axis A.

In this embodiment, the top cone is not shown in the figure. Through relative action of the handle 700 on the body 600, the top cone is driven to move on the central axis A, so that the pipe expanding piece 100 is moved from the closed position to the expanded position to perform the pipe expanding action.

The present disclosure and embodiments thereof are described above in an illustrative manner, which is not restrictive; and what is shown in the drawings is only one of the embodiments of the present disclosure, and its actual structure is not limited thereto. Therefore, is structures and embodiments similar to the technical scheme designed by those of ordinary skills in the art inspired by this disclosure without creativity, without departing from the creative purpose of the present disclosure, are all within a protection scope of the present disclosure.

The invention claimed is:

1. A pipe expanding head, comprising pipe expanding pieces which are circumferentially distributed along a direction of a central axis, wherein the pipe expanding pieces each comprises a first external tooth arc part, a first joint arc part, a second external tooth arc part, a second joint arc part and a positioning part which are sequentially arranged along the direction of the central axis of the pipe expanding head, outer surfaces of the first external tooth arc part and the first joint arc part being in a same arc surface, and outer surfaces of the second external tooth arc part and the second joint arc part being in a same arc surface; and the pipe expanding piece moves between a closed position and an expanded position in a radial direction;

external teeth are provided on both the first external tooth arc part and the second external tooth arc part, and a distance from the external tooth on the first external tooth arc part to the central axis decreases sequentially along the direction of the central axis, while a distance from the external tooth on the second external tooth arc part decreases sequentially along the direction of the central axis;

a first radial cross section is taken as an interface between the first external tooth arc part and the first joint arc part, and a second radial cross section is taken as an interface between the first joint arc part and the second external tooth arc part; and a distance from a point on an outer periphery of a largest radial cross section of the first joint arc part to the central axis is not less than a distance from a point on an outer periphery of the first radial cross section to the central axis, and the distance from the point on the outer periphery of the largest radial cross section of the first joint arc part to the central axis is larger than a distance from a point on an outer periphery of the second radial cross section to the central axis; and a third radial cross section is taken as an interface between the second external tooth arc part and the second joint arc part, and a forth radial cross section is taken as an interface between the second joint arc part and the positioning part; and a distance from a point on an outer periphery of a largest radial cross section of the second joint arc part to the central axis is not less than a distance from a point on an outer periphery of the third radial cross section to the central axis, and the distance from the point on the outer periphery of the largest radial cross section of the second joint arc part to the central axis is larger than a distance from a point on an outer periphery of the forth radial cross section to the central axis.

2. The pipe expanding head according to claim 1, wherein a distance from a point on an outer periphery of a radial section where an outer tooth on the second outer tooth arc part closest to the first joint arc part is located to the central axis is greater than the distance from the point on the outer periphery of the largest radial section of the first joint arc part to the central axis.

3. The pipe expanding head according to claim 1, wherein a side of the positioning part close to the second joint arc part is provided with a stop boss, and a distance from a point on an outer periphery of a radial section of the stop boss to the central axis is greater than a distance from the point on the periphery of the largest radial section of the second joint arc part to the central axis.

4. The pipe expanding head according to claim 1, wherein radians of the outer surface of the first external tooth arc part and the outer surface of the first joint arc part along the direction of the central axis are smaller than radians of the outer surface of the second external tooth arc part and the outer surface of the second joint arc part along the direction of the central axis respectively.

5. The pipe expanding head according to claim 1, wherein an outer surface of the positioning part is provided with an arc groove.

6. The pipe expanding head according to claim 1, wherein a side of the pipe expanding piece close to the central axis is provided with a stressed surface.

7. The pipe expanding head according to claim 1, wherein each pipe expanding piece is integrally formed.

8. The pipe expanding head according to claim 1, wherein the pipe expanding pieces are evenly distributed on an outer periphery of the central axis.

9. A pipe expanding head assembly, comprising a connecting seat and the pipe expanding head according to claim 1, wherein an opening is provided at both ends of the connecting seat, an annular positioning groove is provided in the connecting seat, the positioning part of the pipe expanding piece is connected in the annular positioning groove, an outer side of the positioning part is connected with an elastic piece, and the elastic piece is configured to drive the pipe expanding piece to move from the expanded position to the closed position.

10. A pipe expanding plier, comprising a body, a handle, a top cone and the pipe expanding head assembly according to claim 9, wherein the pipe expanding head assembly is connected to the body, the handle is movably connected with the body, one end of the top cone is connected with the handle and the other end of the top cone is arranged between the pipe expanding pieces and located on the central axis.

11. The pipe expanding head according to claim 2, wherein radians of the outer surface of the first external tooth arc part and the outer surface of the first joint arc part along the direction of the central axis are smaller than radians of the outer surface of the second external tooth arc part and the outer surface of the second joint arc part along the direction of the central axis respectively.

12. The pipe expanding head according to claim 2, wherein an outer surface of the positioning part is provided with an arc groove.

13. The pipe expanding head according to claim 2, wherein a side of the pipe expanding piece close to the central axis is provided with a stressed surface.

14. The pipe expanding head according to claim 2, wherein each pipe expanding piece is integrally formed.

15. The pipe expanding head according to claim 2, wherein the pipe expanding pieces are evenly distributed on an outer periphery of the central axis.

16. The pipe expanding head according to claim 3, wherein radians of the outer surface of the first external tooth arc part and the outer surface of the first joint arc part along the direction of the central axis are smaller than radians of the outer surface of the second external tooth arc part and the outer surface of the second joint arc part along the direction of the central axis respectively.

17. The pipe expanding head according to claim 3, wherein an outer surface of the positioning part is provided with an arc groove.

18. The pipe expanding head according to claim 3, wherein a side of the pipe expanding piece close to the central axis is provided with a stressed surface.

19. The pipe expanding head according to claim 3, wherein each pipe expanding piece is integrally formed.

20. The pipe expanding head according to claim 3, wherein the pipe expanding pieces are evenly distributed on an outer periphery of the central axis.

* * * * *